United States Patent [19]

Discher et al.

[11] Patent Number: 4,665,652

[45] Date of Patent: May 19, 1987

[54] DOOR FRAME STRUCTURE

[75] Inventors: Vernon L. Discher, Golden Valley; Larry K. Holen, Corcoran; Donald N. Mehl, Minnetonka, all of Minn.

[73] Assignee: Norfab, Inc., Minneapolis, Minn.

[21] Appl. No.: 252,814

[22] Filed: Apr. 10, 1981

[51] Int. Cl.[4] ..... E05B 1/00

[52] U.S. Cl. ..... 49/460; 49/501

[58] Field of Search ..... 49/460, 501, 404

[56] References Cited

U.S. PATENT DOCUMENTS

| | | | |
|---|---|---|---|
| 1,908,839 | 5/1933 | Greig | 49/460 X |
| 2,348,937 | 5/1944 | Stahl | 49/460 X |
| 3,403,476 | 10/1968 | Ciucani | 49/501 X |
| 3,837,119 | 9/1974 | Conneally et al. | 49/404 |
| 3,978,617 | 9/1976 | Eventoff | 49/404 |

*Primary Examiner*—Philip C. Kannan

*Attorney, Agent, or Firm*—James R. Haller

[57] ABSTRACT

A door having a peripheral frame. The frame includes a length having side walls and an outer wall defining a generally U-shaped channel. A slot is formed in the side wall of the channel adjacent the outer wall. An accessory, such as a handle, is carried by the frame and includes a tang that extends extending snugly through the slot and protrudes inwardly of the channel. Means are provided to fasten the inwardly protruding tang to the outer wall of the channel, thus rigidly affixing the accessory to the frame.

3 Claims, 11 Drawing Figures

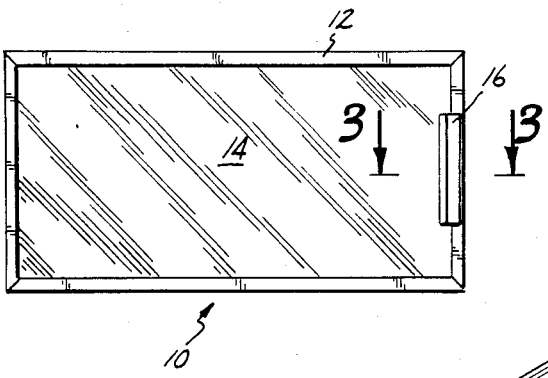
Fig. 1
Fig. 2
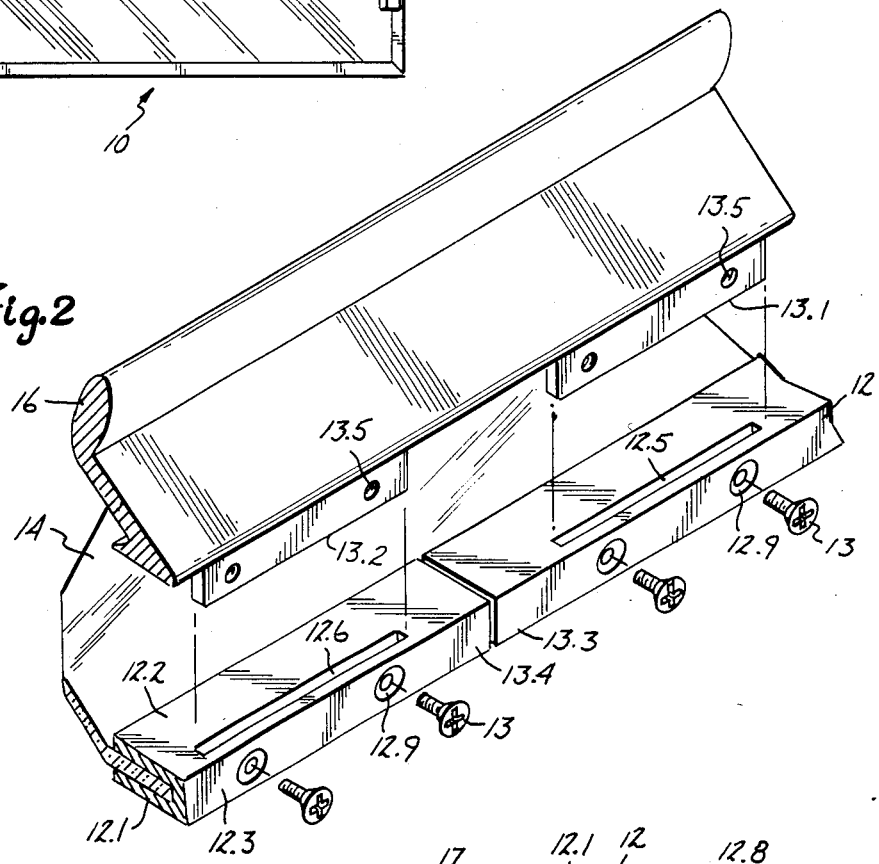
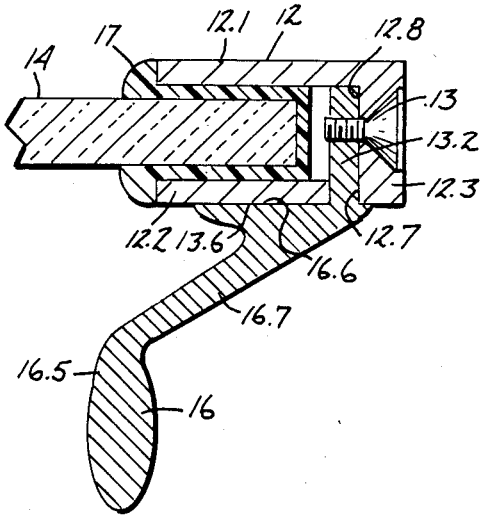
Fig. 3

Fig. 4
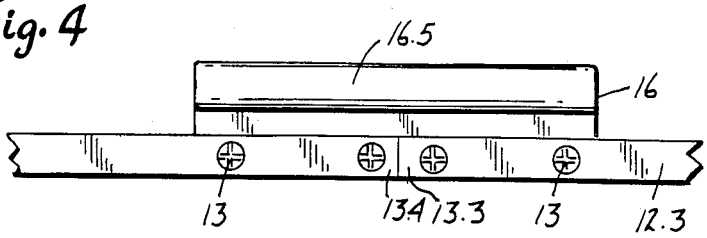
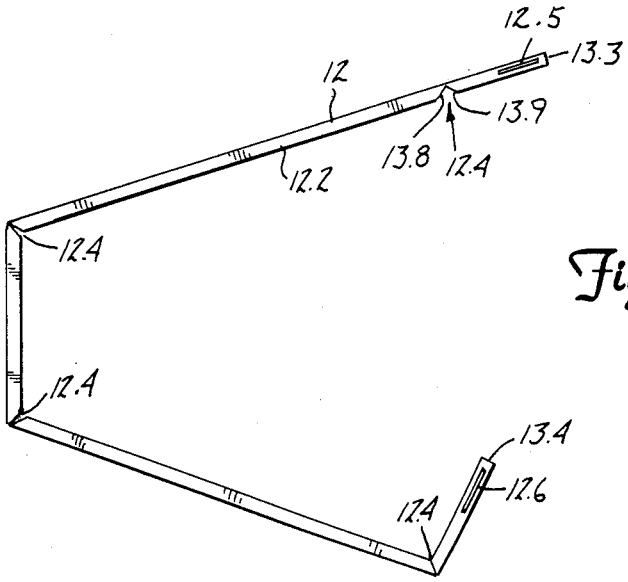
Fig. 5
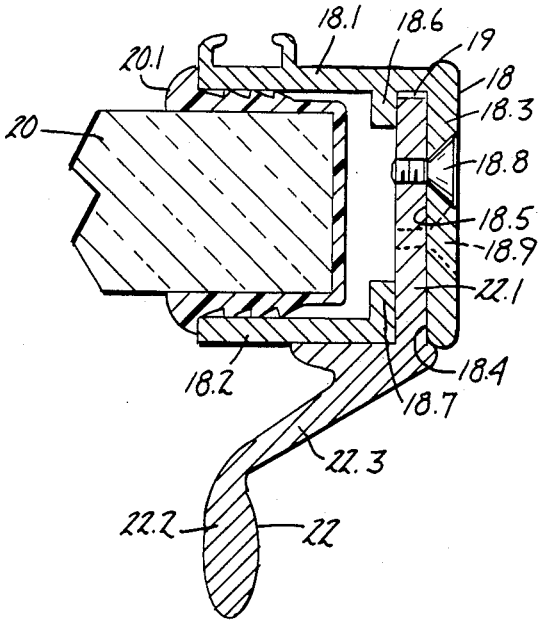
Fig. 6

Fig. 7
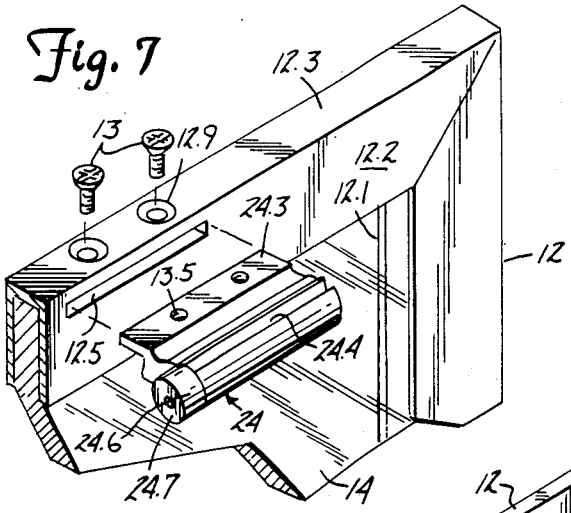
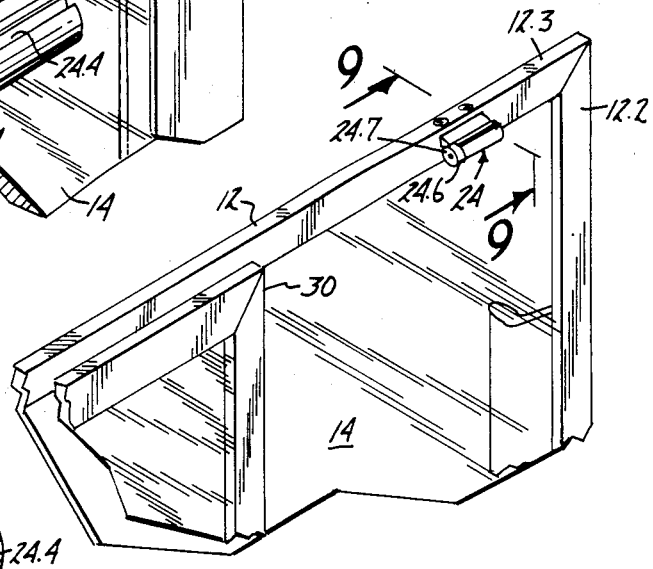
Fig.8
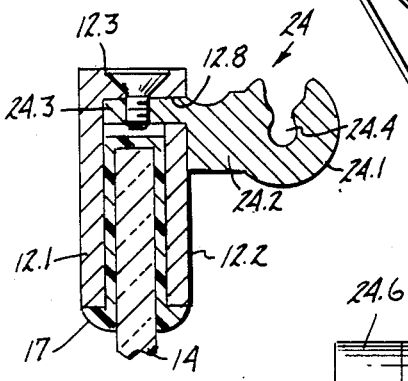
Fig.9
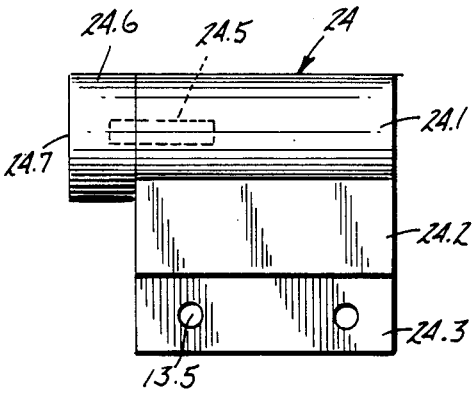
Fig.10
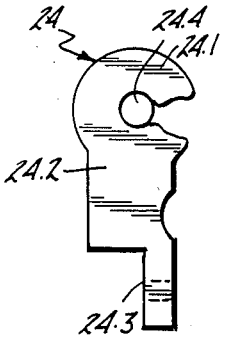
Fig.11

DOOR FRAME STRUCTURE

TECHNICAL FIELD

This invention relates to the technical field of door construction, particularly doors adapted for use with commercial freezers and other cabinetry.

BACKGROUND ART

Doors of the type employed in commercial freezers and in other cabinetry commonly comprise a peripheral frame, which may be formed from metal, e.g., aluminum, extrusions, the frames bearing internal panels such as panes of glass. Such doors may be opened and closed by sliding them along tracks provided for this purpose, or by swinging them about hinges. The doors are provided with handles so that they can be readily opened and closed, and the handles commonly are affixed to the peripheral frame, as shown in U.S. Pat. Nos. 3,514,904 and 3,403,476. Moreover, the frames may be made by welding straight lengths of framing materials, e.g., aluminum extrusions, together at their corners, care being taken to insure that the abutting frame lengths are securely fastened to one another. U.S. Pat. No. 1,970,422 describes a frame for a bedspring, the frame having a pair of frame lengths that are butt-joined together through the use of an external coupler. Door stops, for the purpose of limiting the travel of a door as it is opened, are commonly carried by the jamb of the door rather than by the frame; such construction reduces the likelihood of frame damage or loosening of the door stop were the latter to be carried by the frame instead.

DISCLOSURE OF INVENTION

A door is provided bearing a peripheral frame including at least one length having side walls and an outer wall defining a generally U-shaped channel. The channel has an elongated slot formed in a side wall thereof adjacent the outer wall. An accessory carried by the frame is provided with a tang extending snugly through the slot and protruding inwardly of the channel. Means are provided to fasten the inwardly protruding tang of the handle to the outer wall of the channel, thereby anchoring the tang, and the accessory, to the frame.

In a preferred embodiment, the channel forming the frame has abutting ends, and slots are formed in the side walls adjacent to but spaced from the channel ends. A handle mounted to the frame is provided with spaced tangs dimensioned to extend snugly through the respective slots in the channel ends and to protrude inwardly of the channel. Means are provided to fasten the inwardly protruding tangs to the respective outer walls of the channel ends, the handle maintaining the channel ends in abuttment and stiffening the joint thus formed between the channel ends.

BRIEF DESCRIPTION OF DRAWINGS

FIG. 1 is a side view of a door of the invention;

FIG. 2 is a broken-away, exploded, perspective view of a door of the invention;

FIG. 3 is a cross-sectional view taken along line 3—3 of FIG. 1;

FIG. 4 is an end view of the door of FIG. 1 taken from the right side thereof;

FIG. 5 is a view of a frame employed with a door of the invention as shown in FIGS. 1–4 in an intermediate stage of assembly;

FIG. 6 is a cross-sectional view similar to that of FIG. 3 but showing another embodiment of the invention;

FIG. 7 is a broken-away, exploded, perspective view of a door of the invention showing a specific embodiment thereof employing a door stop;

FIG. 8 is a perspective, broken-away view similar to that of FIG. 7 but showing the door stop in position;

FIG. 9 is a cross-sectional view taken along line 9—9 of FIG. 8;

FIG. 10 is a bottom view of the door stop shown in FIGS. 7–9; and

FIG. 11 is a side view of the door stop shown in FIG. 10.

BEST MODE FOR CARRYING OUT THE INVENTION

A door of the invention is typified generally as 10 in FIG. 1, and includes a frame (12) within which is mounted a glass pane (14). The frame preferably is formed of a single length of a metal extrusion such as an aluminum extrusion, and includes generally parallel side walls (12.1, 12.2) and an outer wall (12.3) forming a generally "U"-shaped channel or channel-like structure. The side walls (12.1, 12.2) of the channel are provided with notches (12.4) along their lengths so that the channel can be appropriately folded, as shown in FIG. 5, into the rectangular configuration shown in FIG. 1, the adjacent edges (13.8, 13.9) of the notches (12.4) coming into abutting relationship with one another. Elongated slots (12.5, 12.6) are formed through the side walls (12.2) and adjacent the channel ends (13.3, 13.4), the slots preferably being rectangular in shape. The slots have an inner surface (12.7 in FIG. 3) that preferably but not necessarily is substantially coextensive with the inner surface (12.8) of the outer wall of the channel (12). As shown in FIG. 2, the outer wall (12.3) of the channel in the vicinity of the slots (12.5, 12.6) is provided with countersunk screw holes (12.9) to receive screws (13). The slots preferably are much longer than they are wide.

A door accessory, typified as a handle (16), and desirably formed from an aluminum extrusion having a cross-sectional shape such as that typified in FIG. 3, is provided with tangs (13.1, 13.2) in the form, desirably, of rectangular tabs, as depicted. The tangs are appropriately dimensioned so as to snugly fit within the respective slots (12.5, 12.6) as shown best in FIGS. 2 and 3. The tangs are so spaced from one another as to extend through the slots when the channel ends (13.3, 13.4) are in proper abutting relationship to one another, as shown in FIG. 2. Referring to FIG. 3, the tangs, typified by tang (13.2), extend through the slots, typified by slot (12.6), and into the interior of the channel (12), the tangs preferably being generally parallel to the outer wall (12.3) of the channel. Fastening means, typified by screws (13), extend through the screw holes (12.9) in the outer wall of the channel and are threaded into threaded screw holes (13.5) formed in the tangs, drawing the tangs themselves outwardly against the inner surface (12.8) of the outer wall of the channel. In this manner, the handle (16) is firmly anchored to the frame (12), and is held rigidly in place not only by the screw (13), but also by the coaction between the tangs (13.1, 13.2) and the respective slots (12.5, 12.6) and further by the supportive contact between the confronting surfaces of the tangs and the inner surface (12.8) of the outer wall of the frame channels. It should be noted that the screw fasteners (13) further preferably maintain surface-to-surface contact between the outer surface (13.6) of the side wall (12.2) and the confronting surface (16.6) of the handle. The handle itself includes a graspable portion (16.5) that is connected to the tang by means of a web (16.7). The frame is provided with a glazing channel (17), commonly of plastic and of known design to appropriately support the pane (14).

Another embodiment of the frame-handle assembly is shown in cross-section in FIG. 6. The embodiment of FIG. 6 is substantially identical to the embodiment shown in FIGS. 1–5, except as noted. The frame depicted in FIG. 6 includes side walls (18.1, 18.2), and an end wall (18.3), defining a generally "U"-shaped channel. The side wall (18.2) is provided with an elongated slot (18.4), similar to the slot shown in FIG. 2. The side walls (18.1) in FIG. 6 are shown as being spaced further apart, however, to accommodate a thicker pane of glass or other panel. The type of panels employed in the invention, of course, is not critical. For the single glass pane shown as (20) in FIG. 6, one may easily substitute a spaced pair of panes in known fashion to reduce heat transfer across the door. A glazing channel for holding the pane (20) is depicted as (20.1).

With further reference to FIG. 6, the handle (22) is provided with tangs, one of which is depicted as (22.1). As in the embodiment shown in FIG. 3, the tang extends nearly entirely across the inner surface (18.5) of the outer wall (18.3) of the channel. Internally, the channel is provided with ribs (18.6, 18.7) that extend inwardly from the respective side walls (18.1, 18.2) and that are spaced by approximately the width of the tang from the inner surface (18.5) of the end wall (18.3), thereby defining inwardly oriented channels (19) coextensive with the slot (18.4) formed in the side wall (18.2). The channel (19) is open to, and supportingly receives, the inwardly protruding tang (22.1). As in the embodiment depicted in FIGS. 1–5, the end wall (18.3) is provided with countersunk screw holes, and the tang (22.1) is provided with mating threaded holes to receive screws (18.8) to thus fasten the tang (22.1) to the end wall (18.3) and, particularly in this embodiment, to restrain the handle (22) from being pulled outwardly of the slot (18.4). Each tang may receive several screws. The screws may be offset; and one offset screw is shown in dashed lines as (18.9) in FIG. 6. As in the embodiment of FIGS. 1–5, the handle (22) desirably is provided with a graspable portion (22.2) that is connected to the tang (22.1) by a web (22.3).

The frame-handle assembly depicted in FIG. 6 operates in the same manner as that depicted in FIGS. 1–5 to maintain the ends of a channel-like frame in rigid abuttment and to stiffen the abuttment joint. The internal channel (19) formed by the end wall (18.3) and the rib (18.6) serves to further secure the tang (22.1) in its slot, and as a result, little axial force is developed on the screws (18.8, 18.9) when the handle is forced in one direction or the other. Further strengthening is provided by the rib (18.7).

It will be understood that the handles (16) and (22) depicted in FIGS. 3 and 6, although representing preferred embodiments, typify external accessories that may be carried by the frame. Other accessories might include door stops (of which one embodiment will be described below), hooks, latches and the like.

FIGS. 7–11 depict an embodiment of the invention in which a door stop, designated generally as (24) is rigidly fastened to the frame of a door. The frame depicted in FIGS. 7–9 for ease of understanding, is identical to the frame shown in FIGS. 1–5, and similar numbering has been employed to identify similar frame elements. That is, the frame is designated generally as (12), and includes side walls (12.1, and 12.2) and an outer wall (12.3), defining a generally "U"-shaped channel.

As depicted in FIGS. 10 and 11, the door stop may be formed of a metal, e.g., aluminum, extrusion having a cross-sectional shape as shown in FIG. 11. The door stop is provided with a generally cylindrical portion (24.1) supported by a generally rectangular spacing block (24.2) from which in turn protrudes a generally rectangular, elongated tang (24.3). The generally cylindrical portion (24.1) of the door stop is slotted along its length to provide an internal, generally circular channel (24.4) that may be threaded to receive a threaded connector (24.5) carrying at its outer end a cylindrical button (24.6) of rubber or the like. The button has an outer, impact surface (24.7). It will be understood that the door stop (24) may be made of other suitable, impact-resistant materials as well, and desirably may be made as an integral unit by injection molding of a suitable plastic.

With reference to FIGS. 7 and 9, the side wall (12.2) of the frame channel is provided with an elongated slot, designated (12.5), the slot running generally parallel to the length of channel in which it is formed. In the drawing, the door stop (24) is shown attached to the uppermost horizontal reach of channel.

The tang (24.3) of the door stop is received snugly within the slot (12.5) in the same manner as the tangs are received within the respective slots in the previously described embodiments, the tang desirably lying along the inner surface (12.8) of the outer wall (12.3) of the channel. The outer channel wall (12.3) is provided with countersunk holes (12.9), and the tang is provided with matching threaded screw holes (13.5). Screws (13) are threaded downwardly through the screw holes (12.9) into the threaded holes (13.5) to rigidly fasten the tang to the outer wall (12.3). As thus described, the coaction between the edges of the slot (12.5) and the edges of the tang (24.3) serve to anchor the door stop to the frame against forces acting axially on the impact surface (24.7). Further, there is little if any axial force applied to the screws (13), tending to loosen the same, during operation of the doors.

FIG. 8 shows a pair of doors adapted to slide past one another and which may be carried within suitable tracks of known design (not shown). It will be understood that as the frame (12) is moved generally to the left in FIG. 8, the door stop (24) will come into contact with the adjacent door, designated (30).

Although the invention has been described primarily in terms of the frame being made of a metal extrusion such as aluminum, and although this indeed represents the preferred embodiment of the invention, the frame may be made of substantially any rigid material, as may the accessories typified as the handle (16) and the door stop (24).

While a preferred embodiment of the present invention has been described, it should be understood that various changes, adaptations, and modifications may be made therein without departing from the spirit of the invention and the scope of the appended claims.

What is claimed is:

1. A door having a generally rectangular, peripheral frame provided with generally parallel side walls and an outer wall defining a generally U-shaped channel, the channel having abutting ends and the side walls adjacent the abutting ends having slots formed therein but spaced from said ends, an accessory having spaced tangs extending snugly through the respective slots and protruding inwardly of the channel, and means fastening the tangs to the respective outer walls of the channel, the accessory maintaining the ends of the channel in abuttment and stiffening the joint thus formed between the channel ends.

2. The door of claim 1 wherein the side walls that are opposed to the slotted side walls include means defining internal channels open to and supportingly receiving the inwardly protruding tangs.

3. The door of claim 1 in which the accessory is a handle for opening and closing the door.

* * * * *